United States Patent [19]

Hwa

[11] 4,190,421

[45] Feb. 26, 1980

[54] FIRESIDE TREATING COMPOSITIONS

[75] Inventor: Chih M. Hwa, Palatine, Ill.

[73] Assignee: Chemed Corporation, Cincinnati, Ohio

[21] Appl. No.: 925,007

[22] Filed: Jul. 17, 1978

[51] Int. Cl.[2] ..... C10L 9/00; C10L 10/00

[52] U.S. Cl. ..... 44/4; 44/1 C; 44/5; 110/343

[58] Field of Search ..... 44/1 C, 4, 5; 110/165 R, 342, 343, 344, 345; 122/379

[56] References Cited

U.S. PATENT DOCUMENTS

| | | | |
|---|---|---|---|
| 2,777,761 | 1/1957 | Tarnoski | 44/5 |
| 2,845,338 | 7/1958 | Ryznar et al. | 44/5 |
| 3,249,075 | 5/1966 | Nelson et al. | 110/343 |
| 4,057,398 | 11/1977 | Bennett et al. | 44/4 |

FOREIGN PATENT DOCUMENTS

| | | | |
|---|---|---|---|
| 1326720 | 4/1963 | France | 44/5 |

*Primary Examiner*—Carl F. Dees
*Attorney, Agent, or Firm*—Charles L. Harness

[57] ABSTRACT

This invention constitutes improvement in the art of introducing fuel additives into the fireside of coal fired boiler tubes to facilitate the removal of slag and like deposits from the fireside, to lower acid smut pollution, to control corrosion, and to improve the electrical resistivity of particulate emission. The improvement is achieved by the addition of pulverized coal to the fuel additives.

2 Claims, No Drawings

FIRESIDE TREATING COMPOSITIONS

The present invention relates to improved means for facilitating the addition of fuel additives to the fireside of boiler tubes and the like.

Fuel additives have been widely used in coal and oil fired boilers to reduce slagging in the boiler tubes, to facilitate the removal of slag and like deposits from the fireside of such boiler tubes, to lower acid smut pollution, to control corrosion, and to improve the electrical resistivity of particulate emission. However, many of these fuel additives are highly hygroscopic powders and tend to cake. The proper and accurate feeding of these additives is often difficult. For these reasons, the present fuel additives have not been completely satisfactory.

The principal object of the present invention is a means for improving the flow properties and feeding characteristics of fuel additives, e.g., coal additives and fuel oil additives.

A further object is the introduction of a filler into the fuel additive to improve the said flow properties and feeding characteristics.

Other objects will be appreciated from the following detailed description of the invention.

The present invention comprises the addition of pulverized coal to the fireside treatment composition whereby they become free flowing powders and are easily fed.

Typical fireside treatment additives (or fuel additives) include ammonium chloride, magnesium oxide, alumina, copper carbonate, and many others, most of which have been characterized by the difficulty that they could not be rendered sufficiently free flowing in themselves to be readily handled and introduced into the furnace.

The preferred range of the additive to coal ratio for the purpose of the present invention is between 1:10 and 10:1. Also, taking A as the miniscule amount of coal used with the additive and B as the fuel being fed which can be either fuel oil or coal, it is preferred that the range of the A:B ratio be between 1:500 and 1:100,000.

The pulverized coal can have the following typical particle size distribution.

| Particle Size in Microns | Amount, % |
|---|---|
| 106 or larger | 43.4 |
| 53–106 | 28.7 |
| 20–53 | 26.1 |
| 5–20 | 1.5 |
| less than 5 | 0.3 |

The "active" ingredients are available commercially in powder form. Therefore, they can be mixed with the pulverized coal as received without further grinding.

For the subject invention, it does not make any difference what kind of coal is used. The coal does not have to be specially treated (for example, dried) before it is pulverized for this use. The additive-coal composition is fed to the furnace using conventional solids additive devices. The compositions can be added to both coal-fired and oil-fired furnaces. For coal-fired furnaces, the treatment can be fed together with the coal to the furnace or added directly to the firebox. For oil-fired furnaces, the treatment is fed directly to the firebox of the furnace. The use of coal will not reduce the efficacy of the additive. In other words, if copper carbonate is added as a combustion catalyst and we now add it along with pulverized coal, the same weight of copper carbonate still does the same job.

The invention is more understood by referring to the following Examples. In these Examples the coal:additive compositions were made up and found to be free flowing as stated; however, their use in boilers was not actually carried out, and this part of the Examples is given on information and belief.

EXAMPLE 1

A Wickes 30,000 pound per hour water tube boiler coal fired with Detroit Stockers generally experiences smoke problems. Ammonium chloride is usually applied to the hopper for smoke control as the coal is being fed to the furnace. However, heretofore ammonium chloride has tended to cake severely making the feed of the treatment very difficult. In order to overcome this difficulty in accordance with the present invention, a composition of 20% ammonium chloride with 80% pulverized coal was used instead of ammonium chloride alone. This improvement was found to eliminate the feeding problem.

EXAMPLE 2

An Eastern plant is operating a field-erected pulverized coal fired boiler. This unit produces 30,000 lbs. per hour steam at 150 psig and superheaters are installed. The coal being burned is Pennsylvania strip coal containing 1% to 2% sulfur and 8% to 11% ash. Severe slagging is occurring in the rear corners of the firebox and on the superheater tubes. This condition requires the boiler operators to spend several hours each shift removing the slag with an air lance. Superheater steam temperature loss between soot blowing cycles is 18° F. meaning that less heat is being transferred within the boiler and this heat is lost in the flue gases. Magnesium oxide is fed to the coal to control the slag problem. However, the feed of magnesium oxide is difficult because of caking. The use of a mixture of 10% magnesium oxide and 90% pulverized coal completely eliminates the caking and feeding problems.

EXAMPLE 3

A 20,000 lbs./hr. water tube boiler is fired with residual fuel oil No. 6 and plagued with excessive slagging. Magnesium oxide is fed directly to the firebox of the boiler to control slagging. Serious feeding problem is experienced because of caking. The use of a mixture of 55% magnesium oxide and 45% pulverized coal overcomes the caking and feeding problems.

EXAMPLE 4

A 400-psig boiler, single retort, is plagued with slag problems. The boiler burns Ohio and Kentucky coal at 65 tons per day, with cyclone separators. Coal analysis shows 11.1% ash, 0.69% sulfur, 4.2% moisture, and a heating value of 13,425 BTU/lb. Alumina is added to the firebox to control slagging. However, the feeding of alumina is troublesome because of the caking problem. The use of 95% alumina and 5% pulverized coal completely eliminates the caking and feeding problems.

The following compositions according to this invention show similar unexpected results in providing free flowing powder and good feeding characteristics.

EXAMPLE 5

| | | |
|---|---|---|
| Copper carbonate | 70% | (combustion catalyst) |
| Pulverized coal | 30% | |

EXAMPLE 6

| | | |
|---|---|---|
| Ammonium chloride | 25% | (smoke controlling agent) |
| Magnesium oxide | 35% | (corrosion and slag controlling agent) |
| Pulverized coal | 40% | |

Applicants' invention is believed to constitute an improvement over the treatment described in the prior art and particularly over U.S. Pat. No. 4,057,398 issued Nov. 8, 1977 to Bennett et al and assigned to Apollo Chemical Corporation. This patent discloses the introduction of a boron compound into a boiler to increase fluidity of the ash. Applicants' invention differs in that Bennett adds the additive to all of the coal being used as fuel, and in a ratio not higher than 1:20, whereas applicants use a much greater additive-to-coal ratio, or range, as defined herein. In addition, applicants' use of the powdered coal additive is miniscule compared to the total coal fed to the furnace. The same would apply to fuel oil.

I claim:

1. A fireside treating composition consisting essentially of a mixture of powdered coal and a fuel additive in a coal:additive ratio of 1:10 to 10:1, in which the additive is a member selected from the group consisting of ammonium chloride, magnesium oxide, alumina, and copper carbonate.

2. Method of feeding a fireside additive to a boiler furnace characterized in that the additive is contained in the composition of claim 1.

* * * * *